US009095989B2

(12) United States Patent
Chang

(10) Patent No.: US 9,095,989 B2
(45) Date of Patent: Aug. 4, 2015

(54) RIP FENCE WITH LOCKNG MECHANISMS

(71) Applicant: Chin-Chin Chang, Taichung (TW)

(72) Inventor: Chin-Chin Chang, Taichung (TW)

( * ) Notice: Subject to any disclaimer, the term of this patent is extended or adjusted under 35 U.S.C. 154(b) by 50 days.

(21) Appl. No.: 14/018,597

(22) Filed: Sep. 5, 2013

(65) Prior Publication Data

US 2015/0059546 A1 Mar. 5, 2015

(51) Int. Cl.

| | |
|---|---|
| ***B27B 27/10*** | (2006.01) |
| ***B27B 27/08*** | (2006.01) |
| ***B27B 27/02*** | (2006.01) |

(52) U.S. Cl.

CPC ..... *B27B 27/08* (2013.01); *B27B 27/02* (2013.01); *B27B 27/10* (2013.01)

(58) Field of Classification Search

CPC ..... B27B 5/16; B27B 5/181; B27B 27/00; B27B 27/02; B27B 27/08; B27B 27/10; B23D 45/06; B26D 7/01

USPC ..... 83/438, 446, 441, 441.1, 467.1, 468.7, 83/477.2; 144/287, 286.1, 307

See application file for complete search history.

(56) References Cited

U.S. PATENT DOCUMENTS

| | | | | |
|---|---|---|---|---|
| 4,658,687 | A * | 4/1987 | Haas et al. | 83/438 |
| 6,360,641 | B1 * | 3/2002 | Talesky et al. | 83/438 |
| 8,312,799 | B2 * | 11/2012 | Frolov | 83/438 |
| 2002/0108480 | A1 * | 8/2002 | Hewitt et al. | 83/446 |
| 2010/0269656 | A1 * | 10/2010 | Frolov | 83/438 |
| 2011/0017040 | A1 * | 1/2011 | Folov | 83/446 |

* cited by examiner

*Primary Examiner* — Phong Nguyen

(57) ABSTRACT

A table saw includes a movable rip fence and a base including an upper cutting surface through which a blade extends. The rip fence includes front and rear clamping mechanisms connected to front and rear ends of a casing respectively. The front clamping mechanism includes a frame, a lever pivotably secured to the frame to be pivotal between a locked position and a released position, the lever having an internal cam member, a clamping member pivotably secured to the lever, the clamping member having a hook at an open end, a spring biased shaft, and a C-clip for retaining an inner end of the shaft in the frame. A pivotal movement of both the lever and the clamping member causes the cam member to push the shaft inward until the shaft is pushed outward to urge against the cam member in the locked position.

5 Claims, 13 Drawing Sheets

RIP FENCE WITH LOCKNG MECHANISMS

BACKGROUND OF THE INVENTION

1. Field of the Invention

The invention relates to a rip fence for use with a table saw and, in particular, to a rip fence having two locking mechanisms at both ends respectively for securing the rip fence in position.

2. Description of Related Art

Table saw is a woodworking tool consisting of a circular saw blade, mounted on an arbor which is driven by an electric motor. The blade protrudes through the surface of a table, which provides support for the material (e.g., wood) being cut.

U.S. Pat. No. 6,360,641 entitled "Rip fence with dual locking mechanism" discloses a table saw comprising a frame having an upper cutting surface through which a blade extends to cut a substance, the upper cutting surface having front and rear edges; a longitudinal slot formed in a surface relative to the front edge; a groove formed in a surface relative to the rear edge; a rip fence including an elongated casing having a front end and a rear end; a front clamping mechanism connected to the front end of the casing, the front clamping mechanism including a handle movable between a locked position and a released position, a clamping plate having a lip at a first end slidably engaged within the slot and laterally movable between the locked position to secure the rip fence in a generally parallel arrangement with the blade and a released position to allow the rip fence to slide through the slot and along the upper cutting surface as the handle moves between the locked and released positions and at least one glide block slidable engaged within the slot, and a front activation plate having an upper end and a lower end, the lower end being connected to the clamping plate and the front activation plate being pivotally connected to the front clamping mechanism between the upper end and the lower end; and a rear clamping mechanism having a tab movable engaged with the groove between a locked position when the handle is in the locked position to secure the rip fence in a generally parallel arrangement with the blade, and a release position when the handle is in a released position to allow the rip fence to slide over the upper cutting surface.

Notwithstanding the prior art, the invention is neither taught nor rendered obvious thereby.

SUMMARY OF THE INVENTION

It is therefore one object of the invention to provide table saw having a movable rip fence, the table saw comprising a base including an upper cutting surface through which a blade extends; a front rail and a rear rail disposed on a front edge and a rear edge of the upper cutting surface respectively; and an adjustment wheel mounted on a front surface of the base; wherein the rip fence comprises an elongated casing having a front end and a rear end; a front clamping mechanism connected to the front end of the casing and including a frame, a lever pivotably secured to the frame to be pivotal between a locked position and a released position, the lever having an internal cam member, a clamping member pivotably secured to the lever, the clamping member having a hook at an open end, a spring biased shaft, and a C-clip for retaining an inner end of the shaft in the frame; and a rear clamping mechanism connected to the rear end of the casing and including a frame, a lever pivotably secured to the frame to be pivotal between the locked position and the released position, and a clamping member pivotably secured to the lever, the clamping member having a hook at an open end; wherein for the front clamping mechanism in the released position of the rip fence, the shaft engages the cam member; and a pivotal movement of both the lever and the clamping member causes the cam member to push the shaft inward until an inner end of the shaft is stopped by the frame, the hook is secured to a bottom of the rear rail, the lever is about oriented downward, the shaft is pushed outward to urge against the cam member, and the shaft is disengaged from the frame at the end of the pivotal movement; and wherein for the rear clamping mechanism a pivotal movement of both the lever and the clamping member from the released position of the rip fence causes the hook to secure to a bottom of the rear rail and causes the lever to be oriented about downward, thereby locking the rear clamping mechanism.

The above and other objects, features and advantages of the invention will become apparent from the following detailed description taken with the accompanying drawings.

DETAILED DESCRIPTION OF THE INVENTION

Figure 1:
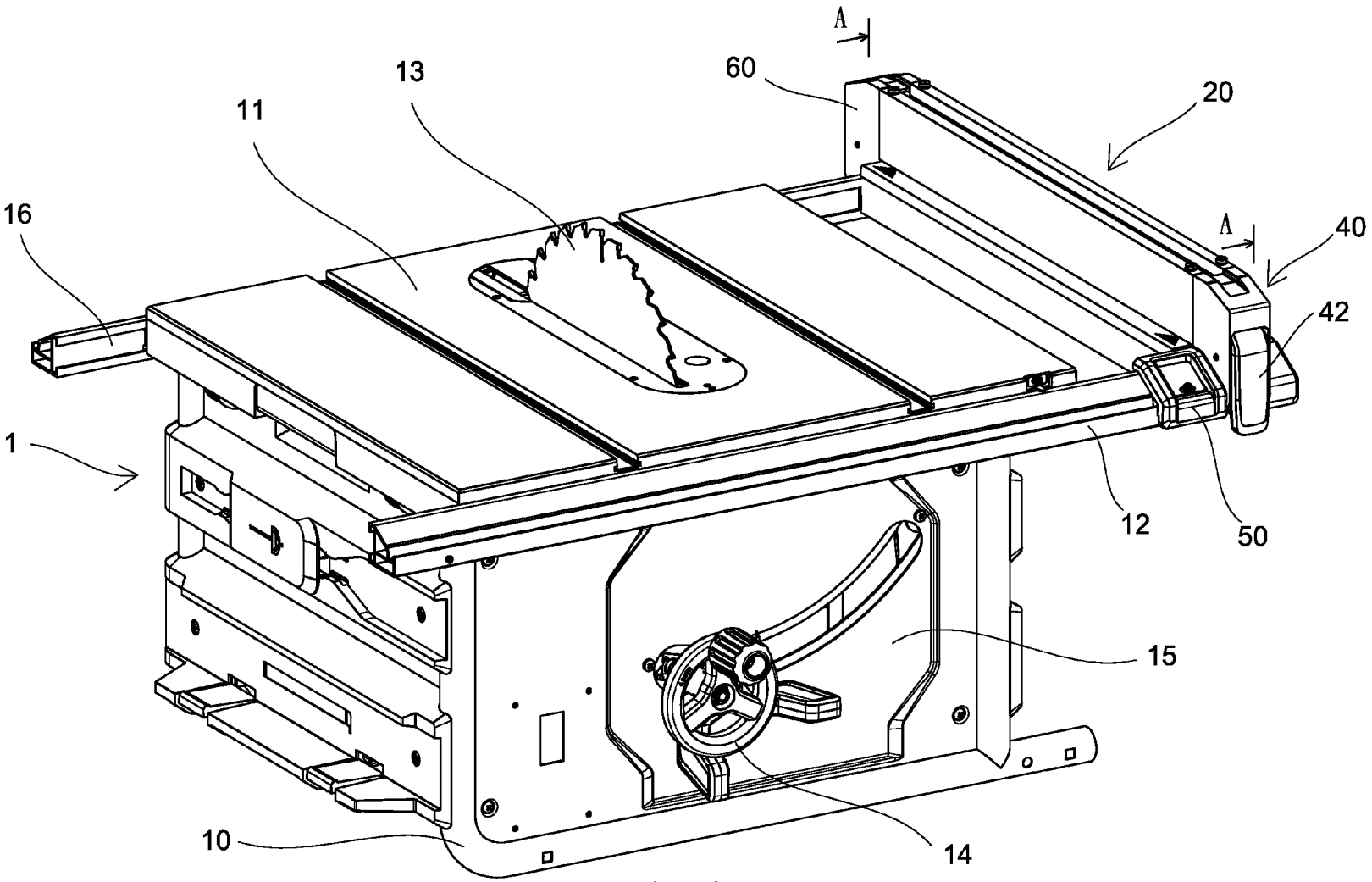
FIG. 1 is a perspective view of a table saw according to a first preferred embodiment of the invention, the table saw incorporating a rip fence made in accordance with the principles of the invention being disposed at the right side of the top of the table saw.
Figure 2:
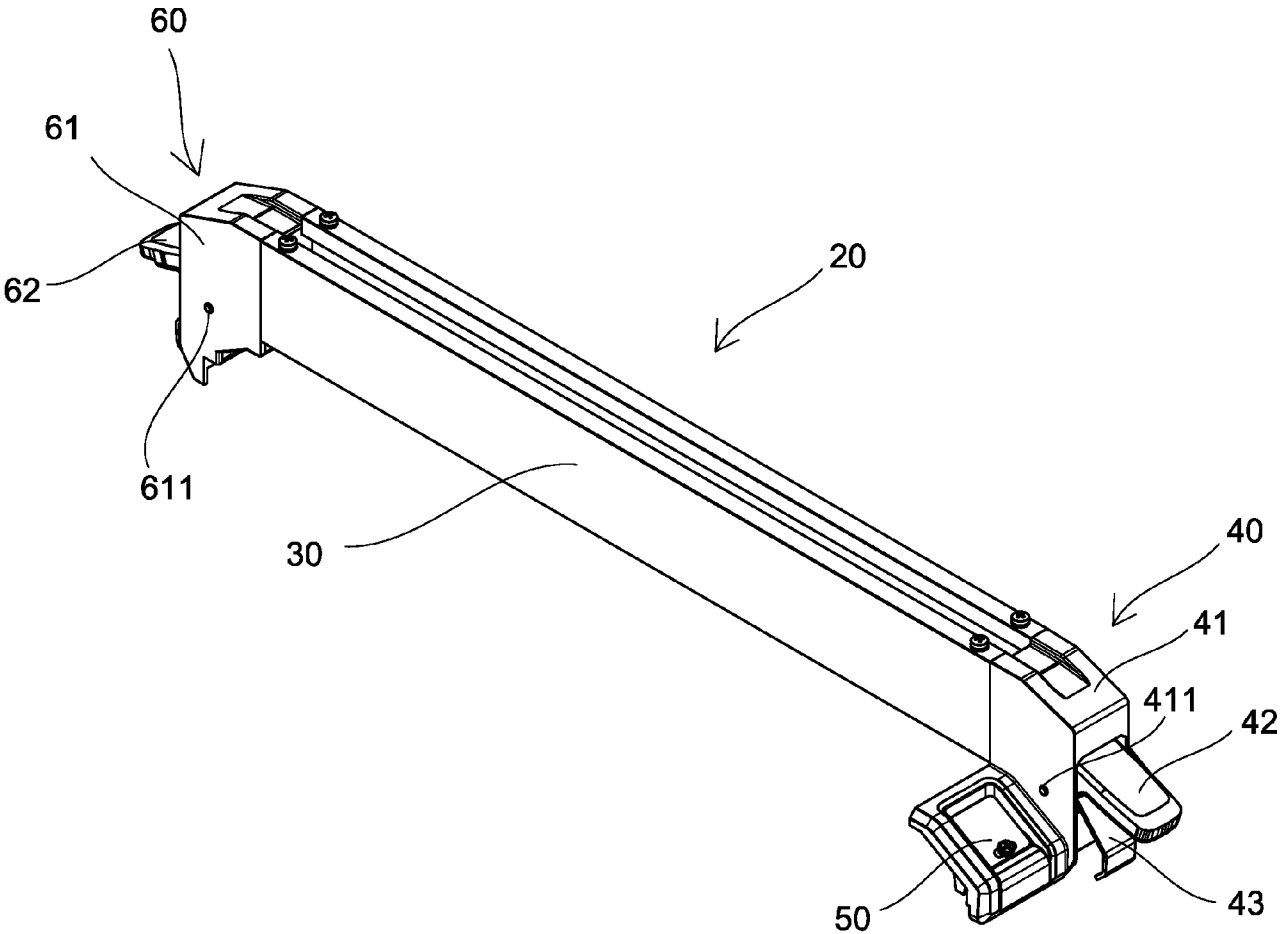
FIG. 2 is a perspective view of the rip fence.
Figure 3:
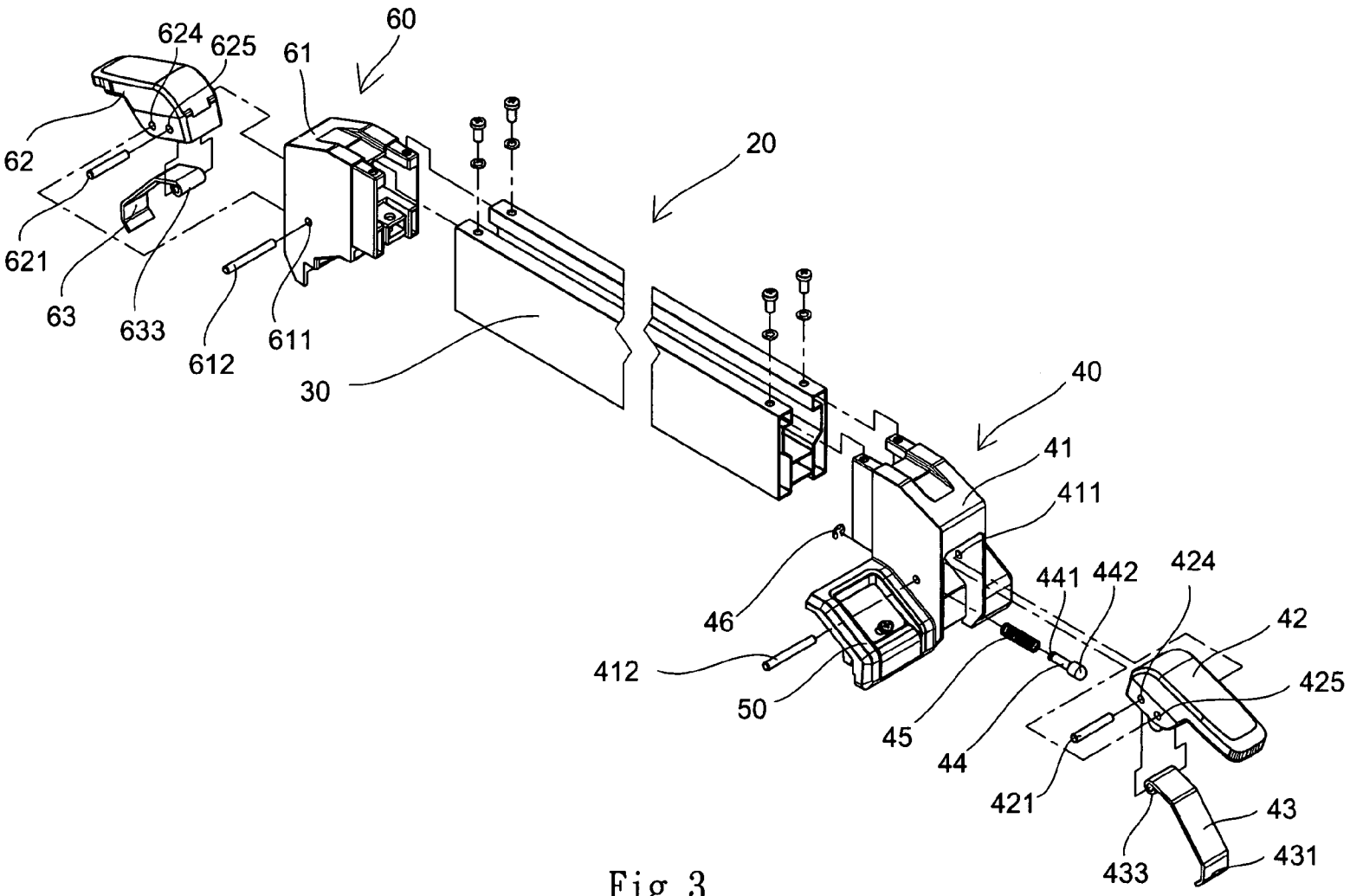
FIG. 3 is an exploded view of the rip fence shown in FIG. 2.
Figure 4:
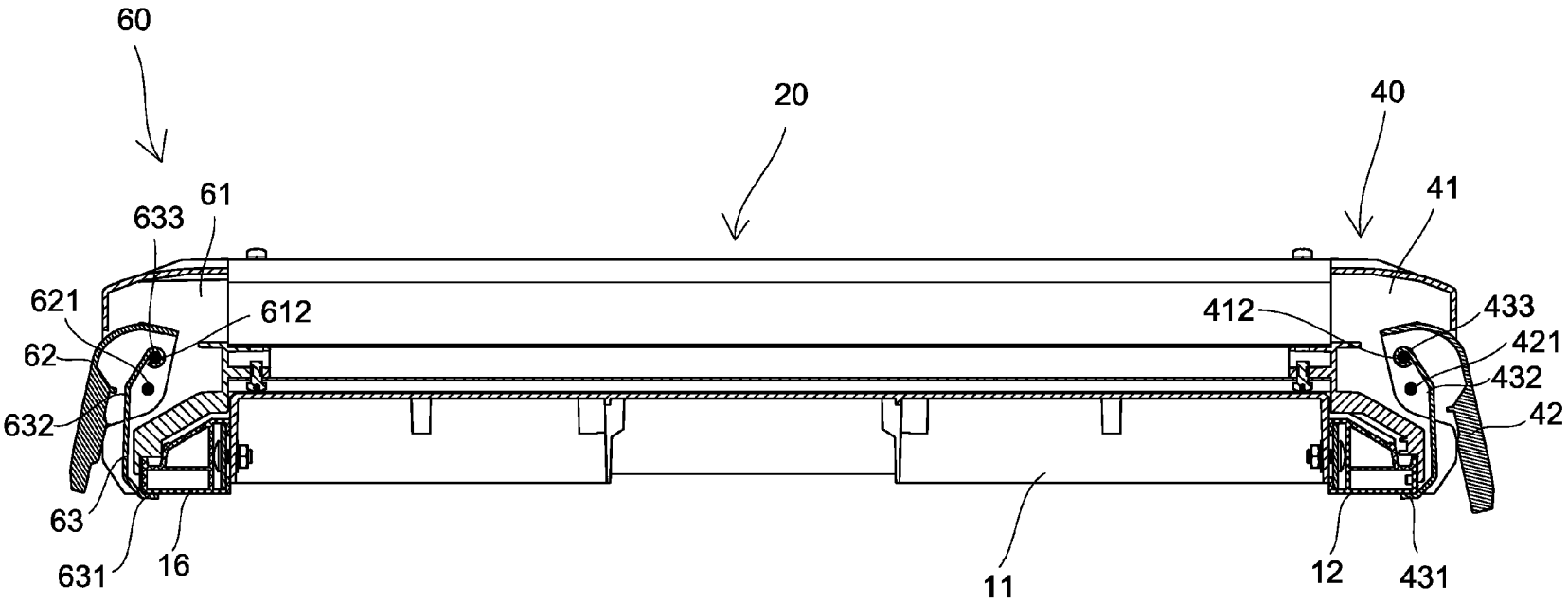
FIG. 4 is a sectional view taken along line A-A of FIG. 1.
Figure 4A:
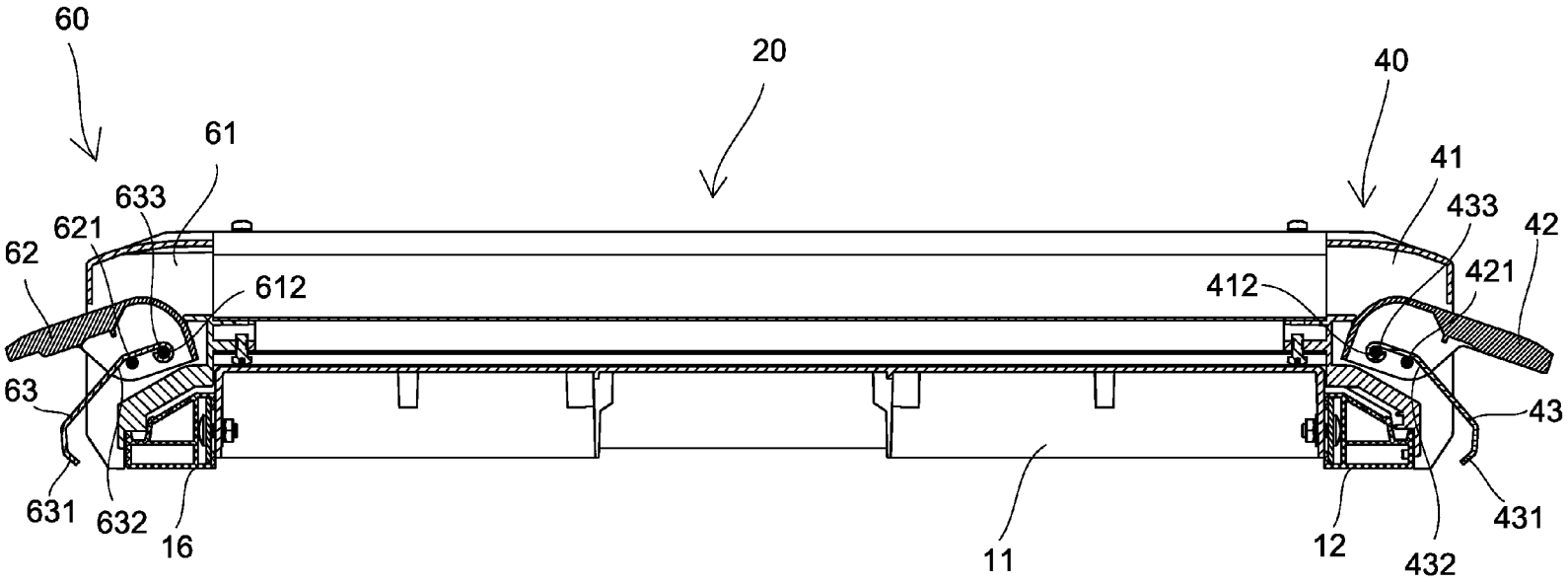
FIG. 4*a* is a view similar to FIG. 4 showing the levers and the clamping members being pivoted to lock the rip fence.
Figure 4B:
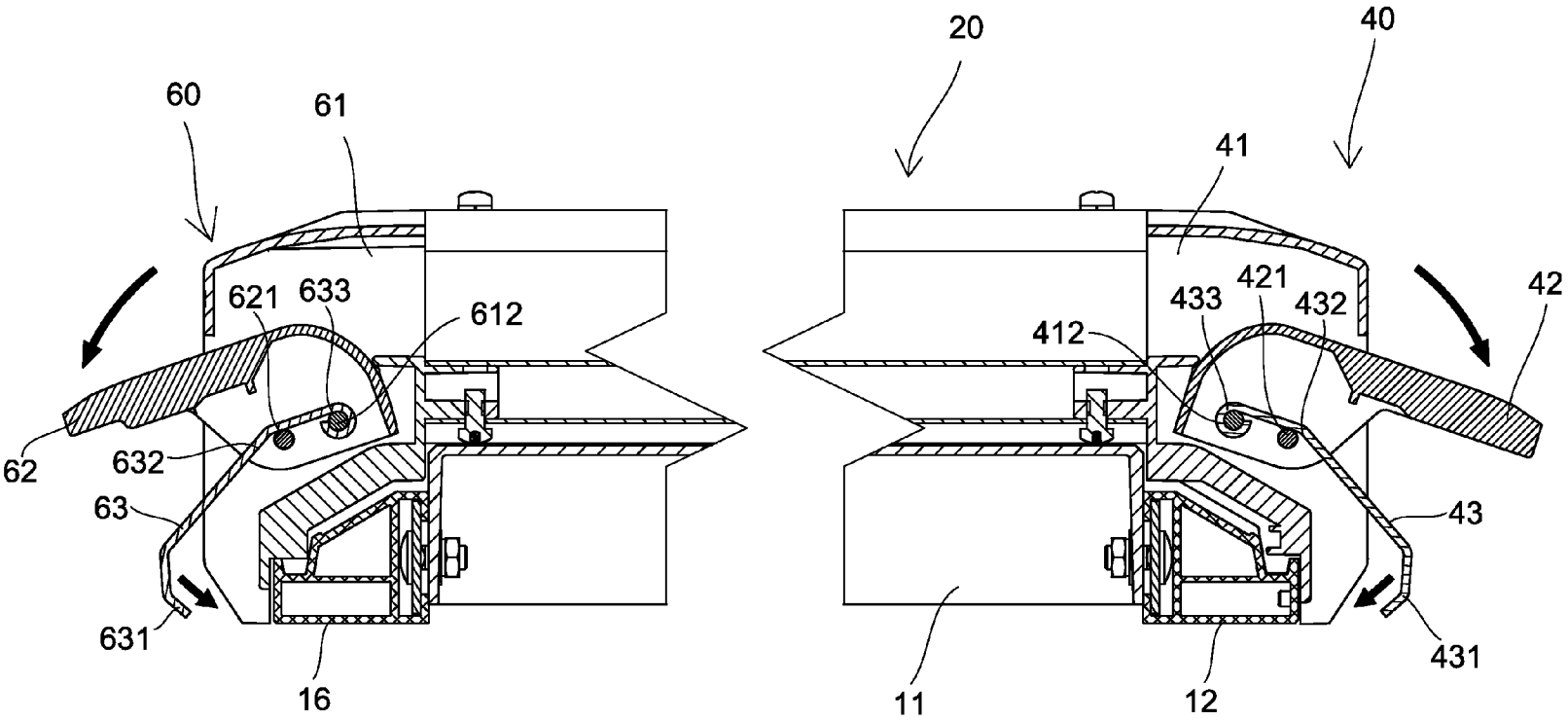
FIG. 4*b* is an enlarged view of both ends of the rip fence of FIG. 4*a* showing the levers and the clamping members being pivoted to lock the rip fence.
Figure 4C:
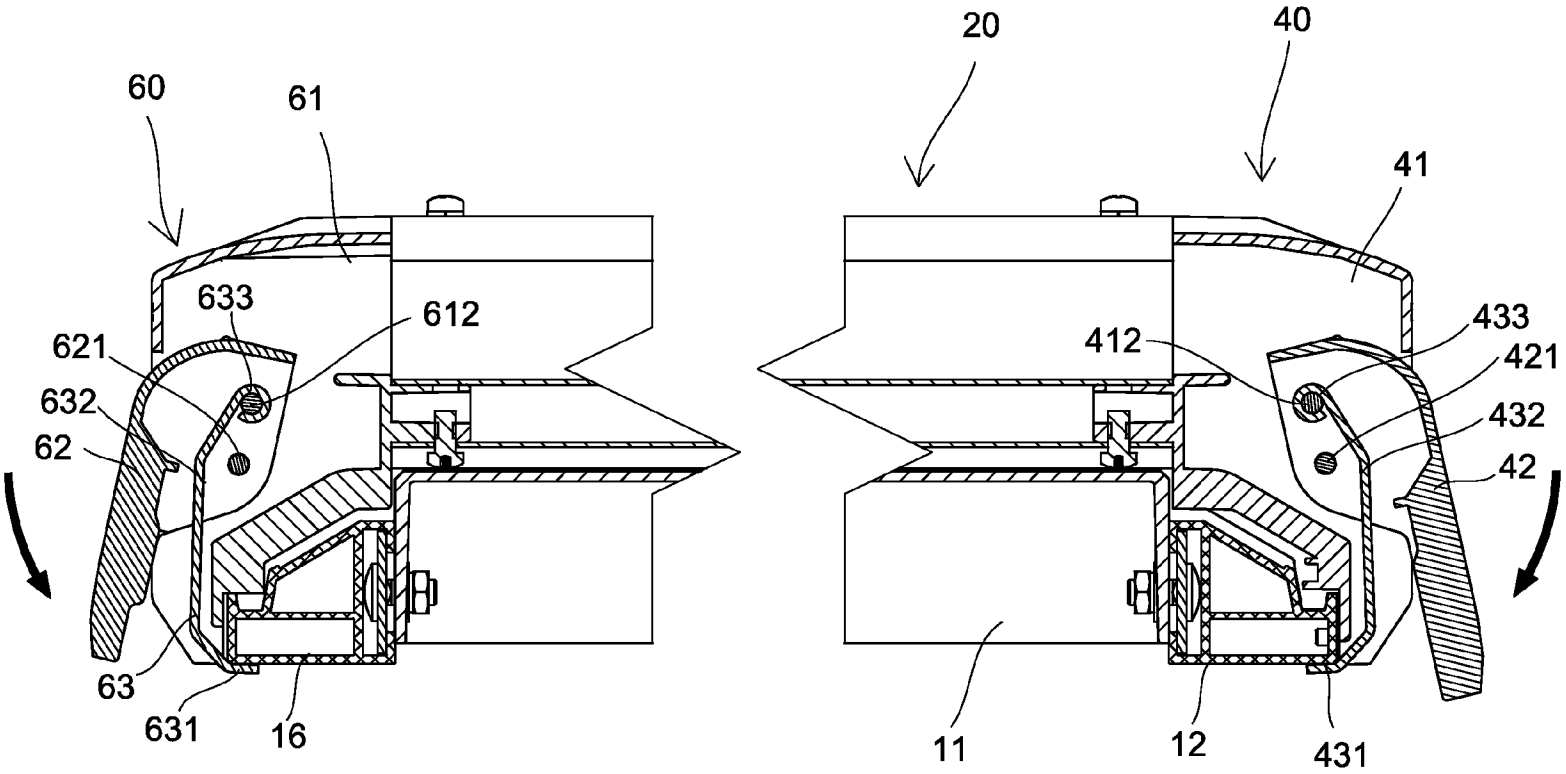
FIG. 4*c* is a view similar to FIG. 4*b* showing the levers and the clamping members being further pivoted to a position about to lock the rip fence.
Figure 5:
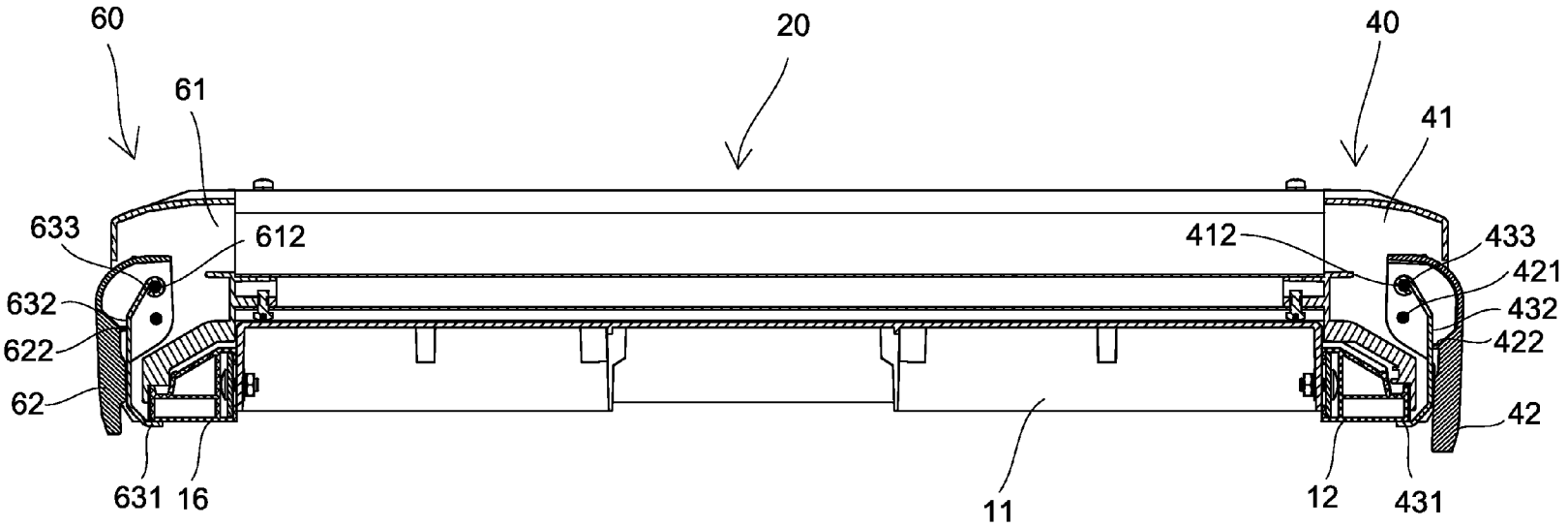
FIG. 5 is a view similar to FIG. 4 showing the rip fence being locked by the levers and the clamping members at the end of the pivotal movement of the levers and the clamping members.
Figure 5A:
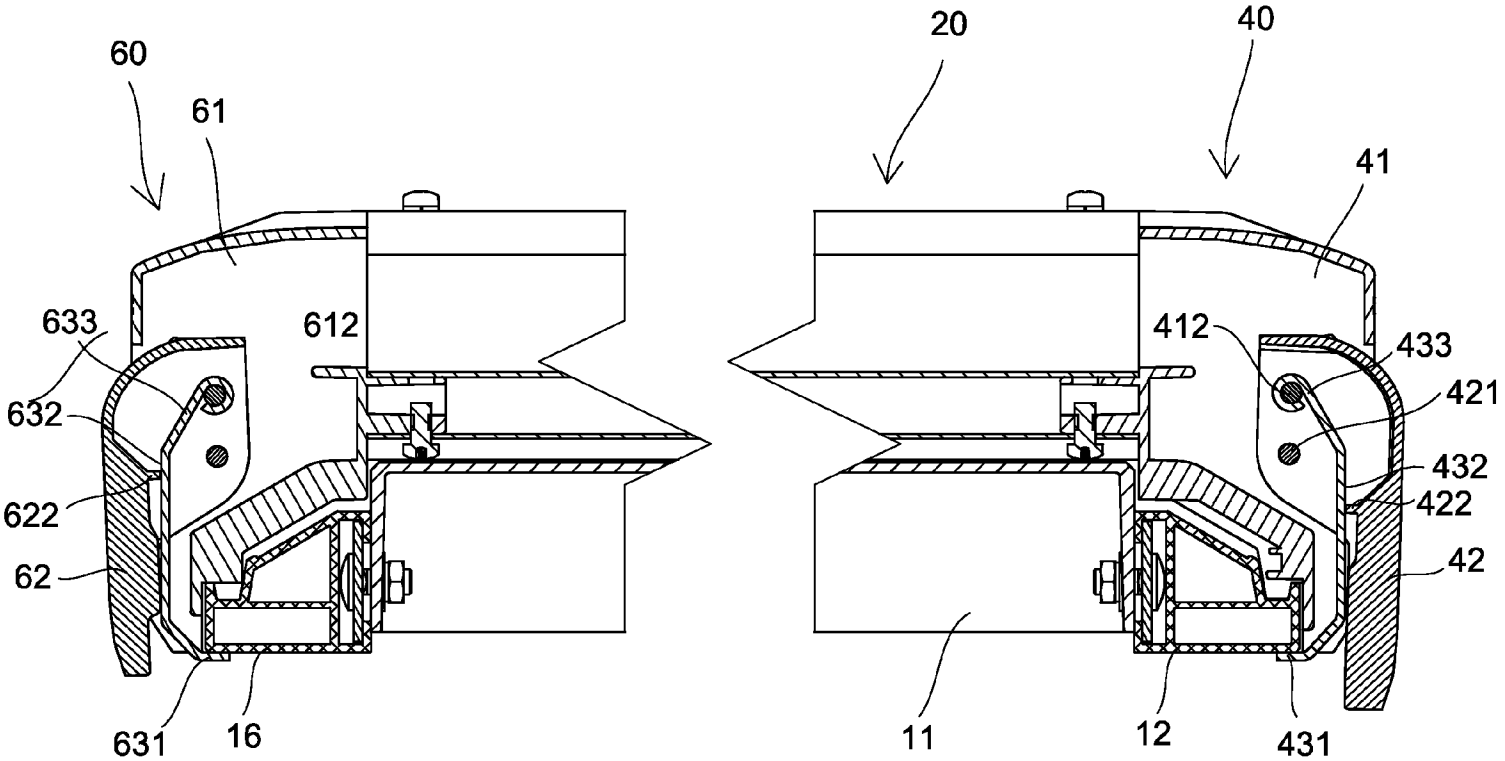
FIG. 5*a* is an enlarged view of both ends of the rip fence of FIG. 5.
Figure 6:
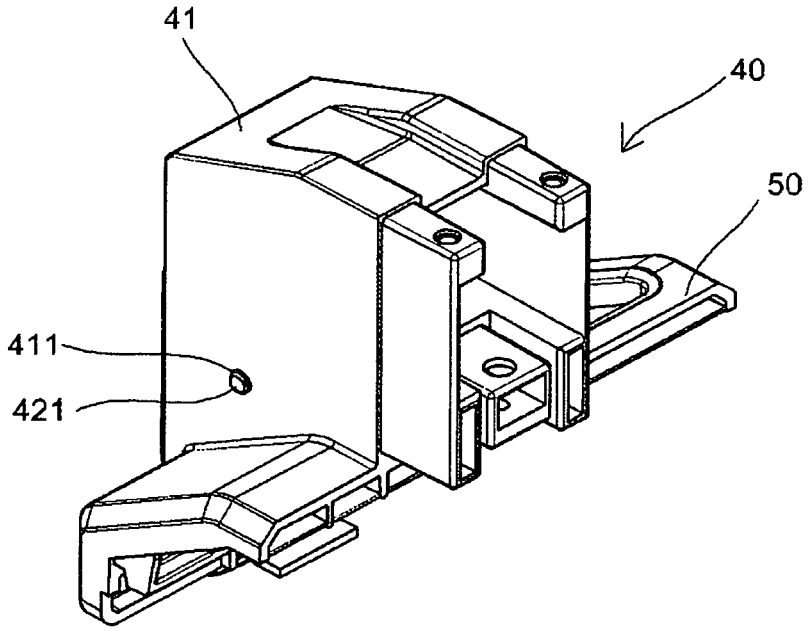
FIG. 6 is a perspective view of the front clamping mechanism.
Figure 7:
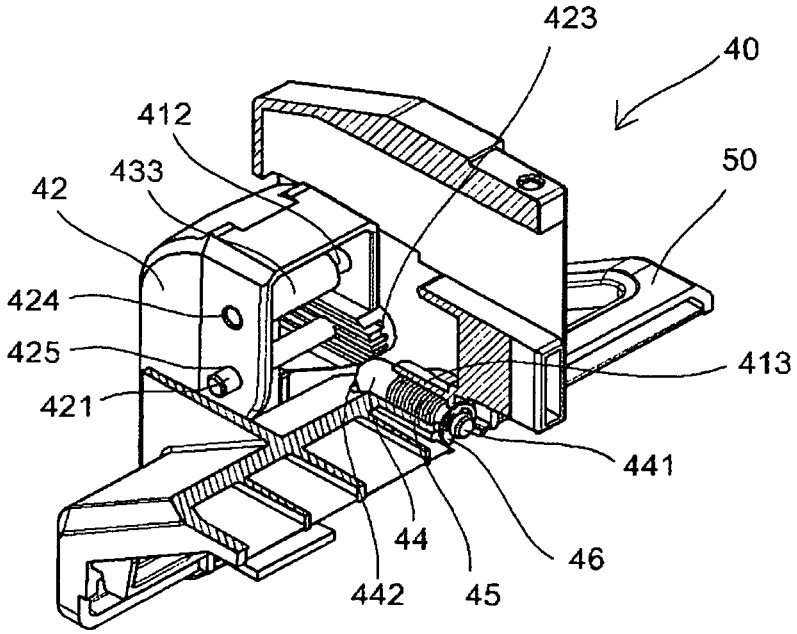
FIG. 7 is a broken away view of the front clamping mechanism.
Figure 8:
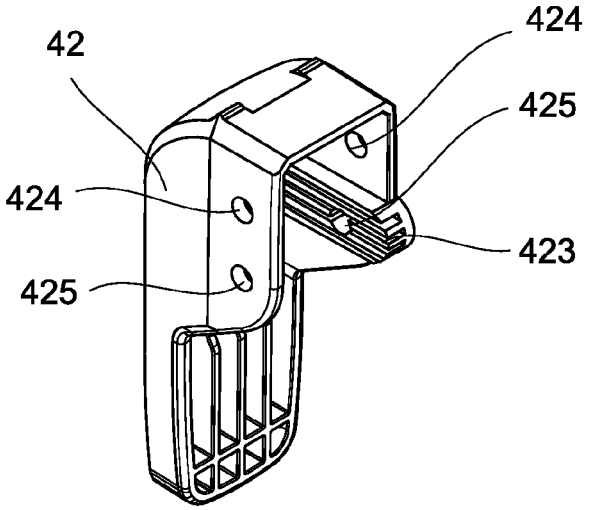
FIG. 8 is a perspective view of the lever.

Referring to FIGS. 1 to 11, a table saw 1 in accordance with a first preferred embodiment of the invention is shown and comprises a base 10, an upper cutting surface 11 mounted on the base 10, parallel front and rear rails 12, 16 mounted on front and rear edges of the upper cutting surface 11 respectively, and a circular saw blade 13 extending upward from the upper cutting surface 11 to be adapted to cut a substance, e.g., wood. The table saw 1 further comprises a rip fence 20 and an adjustment wheel 14 mounted on a front surface 15 of the base 10. The rip fence 20 is slidably mounted on the rails 12, 16 and disposed on the right side of the upper cutting surface 11 in a locked position. In a released position of the rip fence 20, the rip fence 20 can move on the rails 12, 16 relative to the saw blade 13.

The rip fence 20 as the subject of the invention is discussed in detail below. The rip fence 20 comprises a main casing 30, a front clamping mechanism 40, a display 50 attached to one side of the front clamping mechanism 40, and a rear clamping mechanism 60.

The main casing 30 has a generally rectangular tubular form so that two of the outer surfaces are generally perpendicular to the upper cutting surface 11. The main casing 30 is slightly above the upper cutting surface 11 so that the main casing 30 may freely move above the upper cutting surface 11 when the rip fence 20 moves on the rails 12, 16 relative to the saw blade 13. A frame 41 of the front clamping mechanism 40 is threadedly secured to a front end of the main casing 30.

The front clamping mechanism 40 comprises a lever 42 including a transverse first rod member 421, a projection 422 on an inner surface, an internal cam member 423 put on the first rod member 421, two opposite second holes 424 on both sides of the lever 42, and two opposite third holes 425 on both sides of the lever 42. The lever 42 is pivotably secured to the frame 41 by inserting a transverse second rod member 412 through two opposite first holes 411 on both sides of the frame 41 and the third holes 425. Thus, the lever 42 may be disposed between a locked lower position and a released upper position as described in further detail later.

The front clamping mechanism 40 further comprises a clamping member 43 being a bent, resilient metal and including a hook 431 at an open end, an intermediate bend 432, and a C-ring 433 at the other end. The first rod member 421 is inserted through the second holes 424 and the C-ring 433 so as to pivotably secure the lever 42 to the clamping member 43. The front clamping mechanism 40 further comprises a stepped-diameter shaft 44, a torsion spring 45 put on the shaft 44, and a C-clip 46 for retaining an inner end of the shaft 44 in the frame 41.

The frame 41 includes a shaft seat 413 for mounting the shaft 44, the spring 45 and the C-clip 46. The shaft 44 includes a convex second end 442 and a flat first end 441 distal the second end 442. The second end 442 urges against a convex end of the cam member 423. In response to pressing the lever 42, the cam member 423 pushes the second end 442 and the first end 441 presses the upper cutting surface 11. As a result, the rip fence 20 is automatically disposed in parallel to the saw blade 13 and secured thereto.

A frame 61 of the rear clamping mechanism 60 is threadedly secured to a rear end of the main casing 30.

The rear clamping mechanism 60 comprises a lever 62 including a transverse first rod member 621, a projection 622 on an inner surface, an internal cam member put on the first rod member 621, two opposite second holes 624 on both sides of the lever 62, and two opposite third holes 625 on both sides of the lever 62. It is noted that the internal cam member is identical to the internal cam member 423 in FIG. 7. The lever 62 is pivotably secured to the frame 61 by inserting a transverse second rod member 612 through two opposite first holes 611 on both sides of the frame 61 and the third holes 625. Thus, the lever 62 may be disposed between a locked lower position and a released upper position as described in further detail later.

The rear clamping mechanism 60 further comprises a clamping member 63 including a hook 631 at an open end, an intermediate bend 632, and a C-ring 633 at the other end. The first rod member 621 is inserted through the second holes 624 and the C-ring 633 so as to pivotably secure the lever 62 to the clamping member 63.

Figure 9:
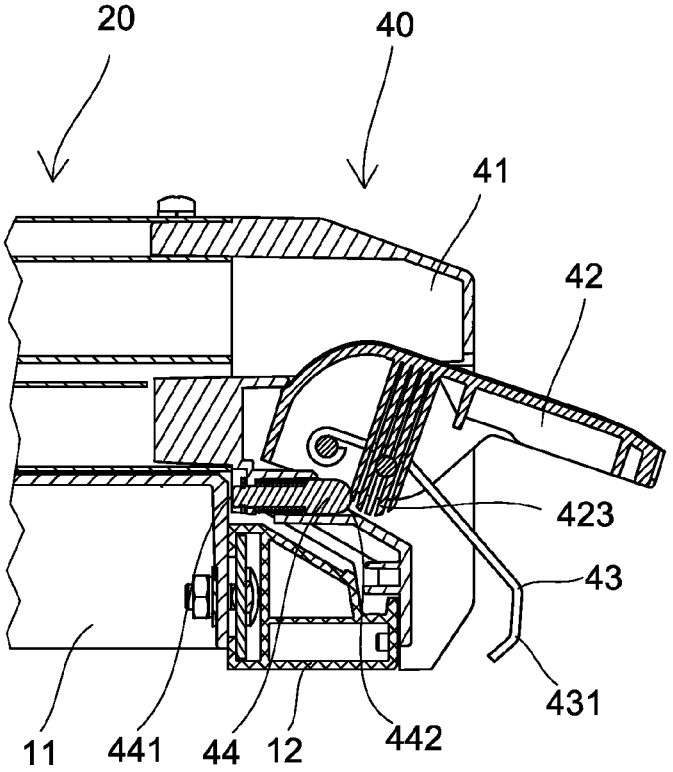
FIG. 9 is a view of the right side of FIG. 4*a* for detailing components.
Figure 10:
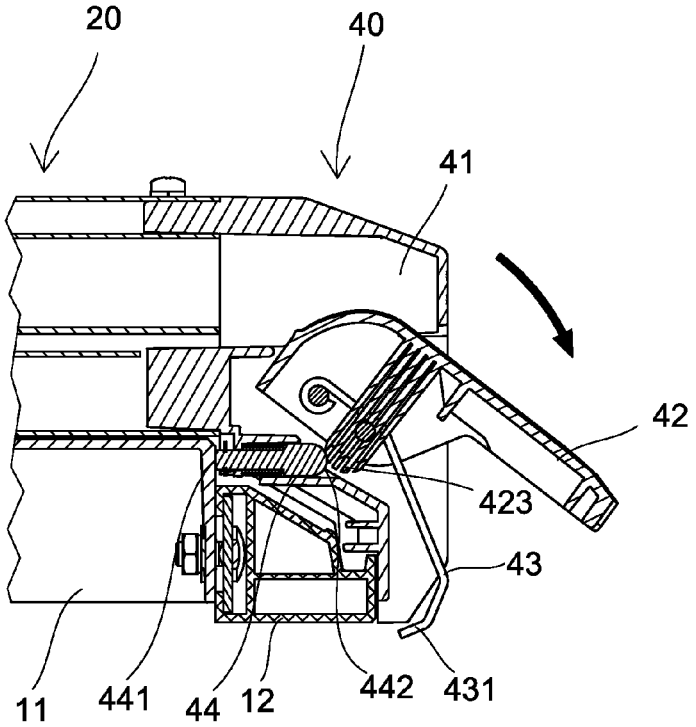
FIG. 10 is a view similar to FIG. 9 showing the lever and the clamping member being pivoted clockwise for locking the rip fence.
Figure 11:
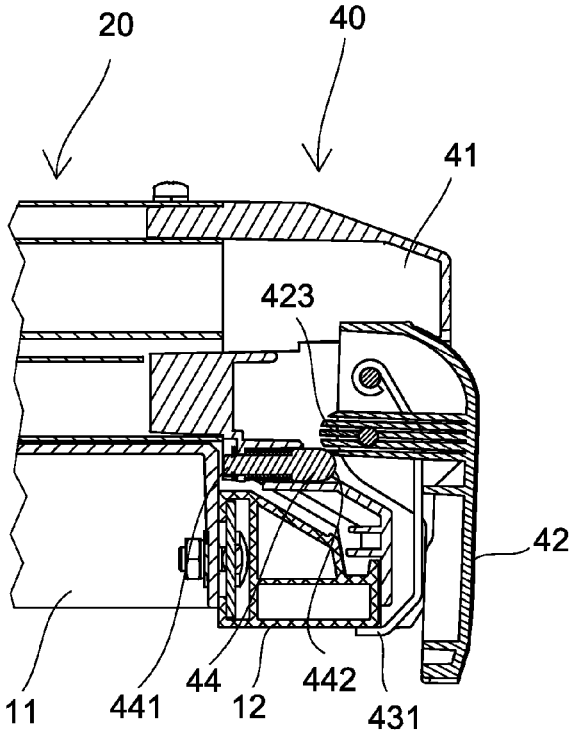
FIG. 11 is a view similar to FIG. 10 showing the rip fence being locked by the lever and the clamping member at the end of the pivotal movement of the lever and the clamping member.

Operations of the invention will be discussed below. A released position of the rip fence 20 with the head of the shaft 44 engaging the cam member 423 is shown in FIG. 9. In this position, an individual may move the rip fence 20 on the rails 12, 16 relative to the saw blade 13 (or the upper cutting surface 11) until a desired position for cutting a substance, e.g., wood is reached. For locking the rip fence, 20, an individual may clockwise pivot the lever 42 (and the clamping member 43) to cause the cam member 423 to ride on the head of the shaft 44, push the shaft 44 inward, and compress the torsion spring 45 until the projection 422 is stopped by the clamping member 43 and the first end 441 of the shaft 44 is stopped by the shaft seat 413 of the frame 41 (see FIGS. 10 and 11). The hook 431 is secured to a bottom of the front rail 12, the lever 42 is about oriented downward, and the shaft 44 is pushed slightly outward by the torsion spring 45 to urge against the cam member 423 and have its inner end disengaged from the shaft seat 413 of the frame 41 at the end of the pivotal movement.

For the rear clamping mechanism 60 a pivotal movement of both the lever 62 and the clamping member 63 from the released position of the rip fence 20 causes the hook 631 to secure to a bottom of the rear rail 16 and causes the lever 62 to be oriented about downward, thereby locking the rear clamping mechanism 60.

Figure 12:
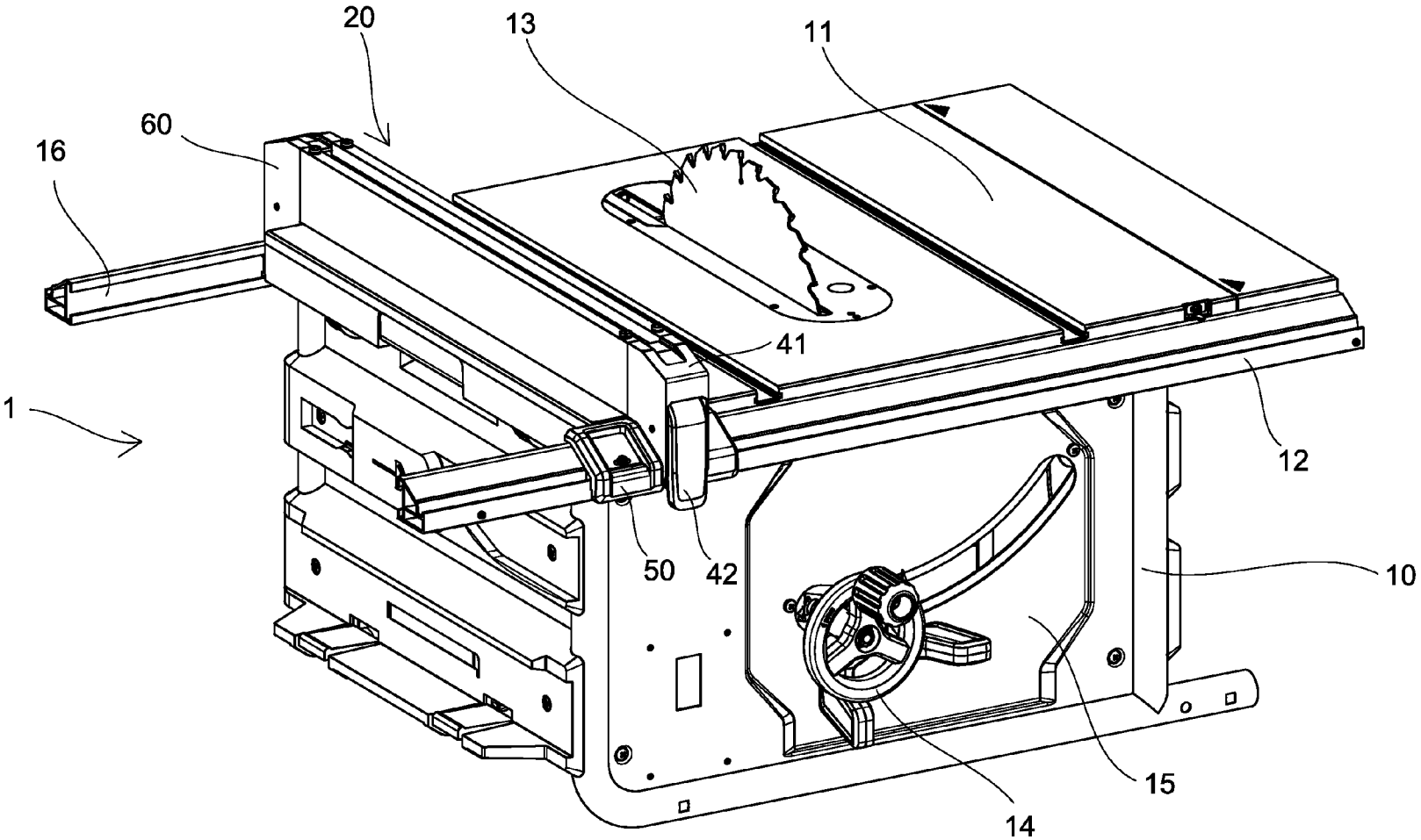
FIG. 12 is a perspective view of a table saw according to a second preferred embodiment of the invention, the table saw incorporating a rip fence made in accordance with the principles of the invention being disposed at the left side of the top of the table saw.

Referring to FIG. 12, a rip fence with locking mechanisms in accordance with a second preferred embodiment of the invention is shown. The characteristics of the second preferred embodiment are substantially the same as that of the first preferred embodiment except the following: The rip fence 20 is located at the left side of the upper cutting surface of the table saw 1.

While the invention has been described in terms of preferred embodiments, those skilled in the art will recognize that the invention can be practiced with modifications within the spirit and scope of the appended claims.

What is claimed is:

1. A table saw having a movable rip fence, the table saw comprising:

a base including an upper cutting surface through which a blade extends;

a front rail and a rear rail disposed on a front edge and a rear edge of the upper cutting surface respectively; and an adjustment wheel mounted on a front surface of the base;

wherein the rip fence comprises:

an elongated casing having a front end and a rear end;

a front clamping mechanism connected to the front end of the elongated casing and including a frame member, a lever member pivotably secured to the frame member to be pivotal between a locked position and a released position, the lever member having an internal cam member, a clamping member pivotably secured to the lever member, the clamping member having a hook at an open end, a spring biased shaft, and a C-clip for retaining an inner end of the spring biased shaft in the frame member; and a rear clamping mechanism connected to the rear end of the casing and including a frame element, a lever element pivotably secured to the frame element to be pivotal between a locked position and a released position, and a clamping element pivotably secured to the lever element, the clamping element having a hook at an open end;

wherein for the front clamping mechanism to be in the locked position, the spring biased shaft engages the internal cam member; and a pivotal movement of both the lever member and the clamping member causes the internal cam member to push the spring biased shaft inward until the inner end of the spring biased shaft is stopped by the frame member, the hook of the clamping member is secured to a bottom of the front rail, the lever member is about oriented downward, the spring biased shaft is pushed outward to urge against the internal cam member, and the spring biased shaft is disengaged from the frame member at the end of the pivotal movement; and wherein for the rear clamping mechanism to be in the locked position, a pivotal movement of both the lever element and the clamping element from the released position of the rip fence causes the hook of the clamping element to secure to a bottom of the rear rail and causes the lever element to be oriented about downward, thereby locking the rear clamping mechanism.

2. The table saw having the movable rip fence of claim 1, wherein the clamping member is a bent and resilient metal, and the clamping element is a bent and resilient metal.

3. The table saw having the movable rip fence of claim 1, wherein a projection of the lever member of the front clamping mechanism urges an intermediate bend of the front clamping mechanism to force the clamping member to urge against the front rail, and a projection of the lever element of the rear clamping mechanism urges an intermediate bend of the rear clamping mechanism to force the clamping element to urge against the rear rail.

4. The table saw having the movable rip fence of claim 1, wherein the frame member is threadedly secured to the front end of the elongated casing and has two opposite first holes, and the lever member includes a first rod member, a second rod member, a projection provided on an inner surface of the lever member, two opposite second holes on both sides of the lever member, and two opposite third holes on both sides of the lever member, wherein the first rod extends through the internal cam member and the two opposite third holes, wherein the lever member is pivotably secured to the frame member by inserting the second rod member through the two opposite first holes on both sides of the frame member and the two opposite second holes of the lever member, thereby disposing the lever member between the locked position and the released position, wherein the clamping member includes the hook at the open end, the intermediate bend, and a C-ring at an opposite end, wherein the second rod member is inserted through the two opposite second holes, the two opposite first holes and the C-ring so as to pivotably secure the lever member to the clamping member, wherein the spring biased shaft comprises a stepped-diameter shaft and a torsion spring provided on the stepped-diameter shaft; and wherein the frame element is threadedly secured to the rear end of the elongated casing and has two opposite first holes, and the lever element includes a first rod element, a second rod element, an internal cam element, a projection provided on an inner surface of the lever element, two opposite second holes on both sides of the lever element respectively, and two opposite third holes on both sides of the lever element respectively, wherein the first rod element extends through the internal cam element and the two opposite third holes, wherein the lever element is pivotably secured to the frame element by inserting the second rod element through the two opposite first holes on both sides of the frame element and the two opposite second holes of the lever element, thereby disposing the lever element between a locked lower position and a released upper position, wherein the clamping element includes a hook at an open end, an intermediate bend, and a C-ring at an opposite end, wherein the second rod element is inserted through the two opposite second holes, the two opposite first holes and the C-ring so as to pivotably secure the lever element to the clamping element.

5. The table saw having the movable rip fence of claim 1, wherein the frame member of the front clamping mechanism includes a shaft seat for mounting the spring biased shaft and the C-clip; wherein the spring biased shaft includes a flat first end and a convex second end distal the first end; and wherein in response to the pressing of the lever member, the internal cam member pushes the second end and the flat first end presses an upper cutting surface, thereby causing the rip fence to automatically dispose in parallel to the saw blade and secure thereto.

* * * * *